US009424824B2

(12) United States Patent
Webman

(10) Patent No.: US 9,424,824 B2
(45) Date of Patent: Aug. 23, 2016

(54) SYSTEM AND METHOD FOR SOUND AUGMENTATION OF ACOUSTIC MUSICAL INSTRUMENTS

(71) Applicant: Ofer Webman, Phoenix, AZ (US)

(72) Inventor: Ofer Webman, Phoenix, AZ (US)

( * ) Notice: Subject to any disclaimer, the term of this patent is extended or adjusted under 35 U.S.C. 154(b) by 0 days.

(21) Appl. No.: 14/828,416

(22) Filed: Aug. 17, 2015

(65) Prior Publication Data

US 2015/0356960 A1 Dec. 10, 2015

Related U.S. Application Data

(63) Continuation-in-part of application No. 14/178,148, filed on Feb. 11, 2014, now Pat. No. 9,111,517.

(51) Int. Cl.

| | |
|---|---|
| ***G10H 1/02*** | (2006.01) |
| ***G10H 1/00*** | (2006.01) |
| ***G10H 3/18*** | (2006.01) |
| ***G10H 3/22*** | (2006.01) |

(52) U.S. Cl.
CPC ..... *G10H 1/0091* (2013.01); *G10H 3/18* (2013.01); *G10H 3/22* (2013.01); *G10H 2220/311* (2013.01)

(58) Field of Classification Search
CPC ..... G10H 3/22; G10H 3/18; G10H 2220/311
USPC ..... 84/737–740
See application file for complete search history.

(56) References Cited

U.S. PATENT DOCUMENTS

| | | | | |
|---|---|---|---|---|
| 4,058,045 | A * | 11/1977 | Jennings et al. | 84/731 |
| 5,010,803 | A * | 4/1991 | Donnell | 84/743 |
| 5,614,688 | A * | 3/1997 | Donnell | 84/743 |
| 5,932,827 | A * | 8/1999 | Osborne et al. | 84/726 |
| 6,441,292 | B1 * | 8/2002 | Donnell | 84/723 |
| 6,542,857 | B1 * | 4/2003 | Holzrichter et al. | 703/2 |
| 7,283,948 | B2 * | 10/2007 | Holzrichter et al. | 704/2 |
| 7,786,374 | B2 * | 8/2010 | Valli et al. | 84/737 |
| 2002/0148346 | A1 * | 10/2002 | Okulov | 84/613 |
| 2006/0117938 | A1 * | 6/2006 | Gillette | 84/723 |
| 2007/0180975 | A1 * | 8/2007 | Paris et al. | 84/291 |
| 2008/0173165 | A1 * | 7/2008 | DeMars | 84/731 |
| 2009/0064853 | A1 * | 3/2009 | Gillette | 84/725 |
| 2011/0192273 | A1 * | 8/2011 | Findley et al. | 84/743 |
| 2015/0082970 | A1 * | 3/2015 | Chekardzhikov | 84/455 |

* cited by examiner

*Primary Examiner* — Jeffrey Donels
(74) *Attorney, Agent, or Firm* — Wright Law Group, PLLC; Mark F. Wright

(57) ABSTRACT

A sound capture device is affixed to an acoustic instrument to capture the natural sound output of the instrument. The captured sound signal is routed to an electronic sound augmentation system that is configured to augment the captured sound with spatial sound effects such as reverb, echo, delay, etc. The processed and augmented sound is then reproduced via a vibrating driver that has been affixed to the body of the acoustic instrument. This creates a situation where the body of the musical instrument, responding to a series of vibrations produced by the vibrating driver, acts as a speaker component, reproducing a rich augmented sound output that comprises the sum of the sound produced by the original sound production capabilities of the acoustical instrument plus the added augmented or enhanced sound effects.

19 Claims, 8 Drawing Sheets

SYSTEM AND METHOD FOR SOUND AUGMENTATION OF ACOUSTIC MUSICAL INSTRUMENTS

CROSS REFERENCE TO RELATED APPLICATION

This continuation-in-part patent application claims the benefit of U.S. patent application Ser. No. 14/178,148, which application was filed on Feb. 11, 2014, which application is currently pending, and which application is incorporated herein by reference.

BACKGROUND OF THE INVENTION

1. Technical Field

The present invention relates generally to the field of acoustics and more specifically relates to systems and methods for creating enhanced sound profiles for acoustical instruments.

2. Background Art

Music and musical instruments are an important part of most societies and stringed instruments, such as guitars, are popular throughout the world. Many variations of musical instruments exist, both acoustic and electrical, in many forms, shapes, and sizes. Often, depending on the venue and the style of the music, different types of sounds and sound effects may be desired in order to present the music to the audience in the most artistic fashion. In many cases, the sound level of an instrument will be boosted by the use of electronic devices such as amplifiers and speakers. This is especially the case for acoustical instruments when the acoustical instrument is being used in conjunction with electric instruments and when acoustical instruments are being played in venues that require some form of amplification due to the size of the venue and/or the audience.

In addition to controlling the volume of the sound produced by an instrument, it is fairly common to use digital signal processing equipment and techniques to modify or enhance the sound produced by a musical instrument. While sound amplification and augmentation are common activities, they generally require the use of large, bulky, and expensive equipment. Additionally, this equipment is electronic and requires ready access to a power source in order to function properly. However, in many cases, a musician will not have access to a power source and will not have the time, space and/or money required to amplify and augment the sound of their instrument using conventional devices and methods. Once again, this is especially problematic for acoustical instruments since these instruments generally have no readily available sound amplification or augmentation capabilities.

Accordingly, without improvements in the current systems and methods for creating enhanced acoustical profiles for acoustical instruments, particularly guitars, violins, and other stringed instruments, the ability to effectively and efficiently provide musicians with enhanced mobility and freedom for musical performances will continue to be sub-optimal.

BRIEF SUMMARY OF THE INVENTION

A novel electronic system provides for augmentation of the sound produced by one or more acoustical instruments. While particularly well adapted for acoustical guitars and other acoustic stringed instruments (e.g., banjos, violins, violas, etc.), the system can be adapted to a wide variety of acoustic instruments. A sound capture device is affixed to an acoustic instrument to capture the natural sound output of the instrument. The captured sound signal is routed to an electronic sound augmentation system that is configured to augment the captured sound with spatial sound effects such as reverb, echo, delay, etc. The processed and augmented sound is then reproduced via a vibrating driver that has been affixed to the body of the acoustic instrument. This creates a situation where the body of the musical instrument, responding to a series of vibrations produced by the vibrating driver, acts as a speaker component, reproducing a rich augmented sound output that comprises the sum of the sound produced by the original sound production capabilities of the acoustical instrument plus the added augmented or enhanced sound effects.

BRIEF DESCRIPTION OF THE FIGURES

The preferred embodiments of the present invention will hereinafter be described in conjunction with the appended drawings, wherein like designations denote like elements, and.

DETAILED DESCRIPTION OF THE INVENTION

Figure 1:
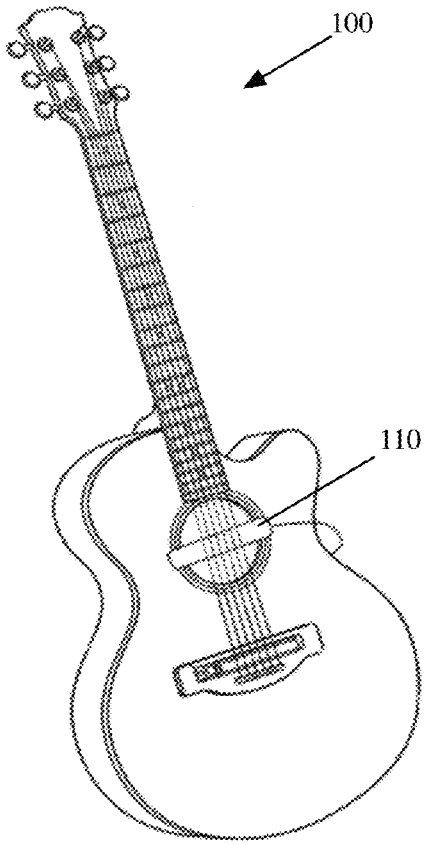
FIG. 1 is a front perspective view of a guitar that has been provided with a sound augmentation system in accordance with a preferred exemplary embodiment of the present invention.

The system and method of the present invention provides for augmentation of the sound generated by musical instruments, particularly acoustic instruments. While most suitable for acoustic stringed instruments, the system can be adapted to a wide variety of acoustical instruments. An audio capture device such as a magnetic, optic, or piezo-electric pickup is attached to an acoustic instrument to capture the sound output of the instrument. The various preferred embodiments of the present invention provide for augmentation of the sound produced by the acoustic instrument. While particularly well adapted for acoustical guitars and other acoustic stringed instruments (e.g., banjos, violins, violas, etc.), the system can be adapted to a wide variety of acoustic instruments.

The audio capture device is affixed to an acoustic instrument to capture the natural sound output of the instrument. The captured sound signal is routed to an electronic sound augmentation system that is configured to augment the captured sound with spatial sound effects such as reverb, echo, delay, etc. The processed and augmented sound is then reproduced via a vibrating driver that has been affixed to the body of the acoustic instrument. This creates a situation where the body of the musical instrument, responding to a series of vibrations produced by the vibrating driver, acts as a speaker component, reproducing a rich augmented sound output that comprises the sum of the sound produced by the original sound production capabilities of the acoustical instrument plus the added augmented or enhanced sound effects.

Based on the musician's preferences, a wide variety of sound effects and enhancements can be added to the natural sound output of the acoustic instrument. The various preferred embodiments of the present invention can be used to create rich and complex layered sounds that are added to the natural sound output of an acoustic instrument, thereby creating effects that cannot readily be achieved without much larger and more expensive equipment.

By implementing one or more preferred embodiments of the present invention, a musician has the ability to quickly add to, manipulate, and/or augment the natural sound of an acoustic musical instrument, essentially making the instrument more versatile and more creative to play. The sound augmentation system described herein is very small, highly portable, and relatively self-contained. The only power source needed to operate the sound augmentation system described herein is a small battery housed within the device. No external speakers, amplifiers, power sources, etc. are necessary. This allows the musician to carry the sound augmentation system in a small kit bag or other carrying case or simply leave the sound augmentation system attached to the instrument.

Those skilled in the art will appreciate that the sound augmentation system of the present invention provides:

- the ability to enhance the sound and feel of the musical sound produced by an acoustic instrument by extending overtones and harmonic complexity;
- the ability to reproduce sound effects such as delay, reverb etc. without an external speaker, using the sound box or chamber of the acoustic instrument, essentially making the instrument more versatile, enjoyable, and creative to play;
- the ability to modify the source audio signal produced by the musical instrument without any structural modification to the musical instrument;
- the ability for the musician to quickly and easily install and uninstall the sound augmentation system in a matter of minutes, with no special tools or knowledge being required;
- the ability to transport the musical instrument with the invention installed on the musical instrument, while retaining the original mobility of the musical instrument while eliminating any dependency on expensive, heavy, cumbersome and power hungry external components.

Referring now to FIG. 1, an acoustic guitar that has been provided with a sound augmentation system in accordance with a preferred exemplary embodiment of the present invention is depicted. As shown in FIG. 1, an acoustic guitar 100, the musician places an audio capture device into the guitar's sound hole on the front of the guitar. Audio capture device 110 is any device or component capable of capturing the source audio signal produced by the guitar at the sound hole (e.g., microphone, magnetic, optical, or acoustic audio pickup, etc.).

Figure 2:
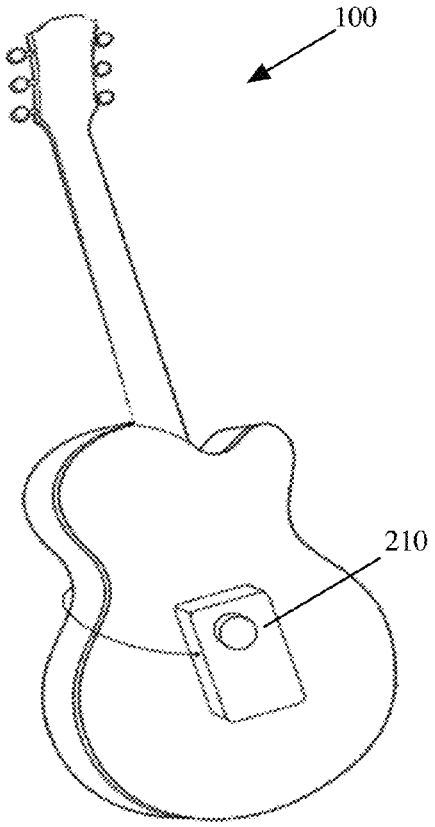
FIG. 2 is a rear perspective view of a guitar that has been provided with a sound augmentation system in accordance with a preferred exemplary embodiment of the present invention.

Referring now to FIG. 2, the musician will also attach a sound augmentation system 210 to the backside of the guitar using any non-permanent bonding solution known to those skilled in the art (e.g., reusable adhesive putty, double-sided tape or stickers, one or more suction cups, etc.). Additional information about the various methods used to attach sound augmentation system 210 to a musical instrument is presented below. It should be noted that the guitar or other acoustic instrument will generally comprise a front surface, where the front surface comprises a sound hole with a plurality of strings extending over the sound hole and a back surface positioned substantially parallel to the front surface. When sound augmentation system 210 is affixed to the guitar, sound augmentation system 210 will be on the back surface of the guitar, away from the strings and the sound hole.

Audio capture device 110 is then communicatively coupled to sound augmentation system 210 via an electronic cable or some other communication method such as an optional wireless connection. With the sound augmentation system installed, the musician plays the guitar in the normal fashion (e.g., strumming or plucking the strings) and audio capture device 110 captures the original source audio signal produced by the guitar and transfers the original source audio signal to sound augmentation system 210. At that point, based on the musician's preferences, sound augmentation system 210 is configured to route the original source audio signal to an internal DSP that has been designed and configured to augment and/or add sound effects (e.g., "delay," "reverb," "flanger," etc.) to the original source audio signal produced by the guitar, thereby producing an augmented audio signal.

After any desired augmentation effects have been added, the augmented audio signal is transferred to a vibrating driver contained within or affixed to sound augmentation system 210, providing vibrations from the vibrating driver to the surface area on the back of the guitar where the sound augmentation system 210 has been affixed. In this fashion, the back surface of the guitar acts as a speaker diaphragm to produce additional vibrational sounds within the sound chamber of the guitar. These new vibrations are added to or layered over the natural vibrations occurred by the vibration of the mechanical strings, and together creates a new augmented sound, which is then naturally amplified by the instrument's acoustic sound box.

Figure 3:
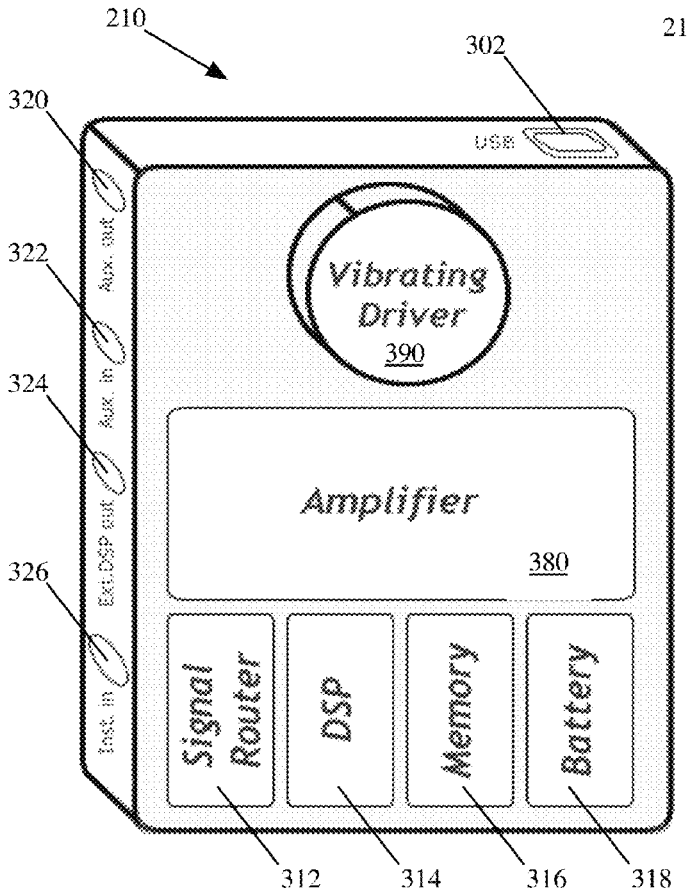
FIG. 3 is a schematic representation of the front of a housing used in conjunction with a sound augmentation system in accordance with a preferred exemplary embodiment of the present invention.

Referring now to FIG. 3, a schematic representation of the front of a housing used in conjunction with a sound augmentation system 210 in accordance with a preferred exemplary embodiment of the present invention is depicted. As shown in FIG. 2, the most preferred embodiments of the present invention comprise a series of components that, in concert, provide the functionality of the sound augmentation system of the present invention. Sound augmentation system 210 comprises: a USB port 302; an auxiliary out port 320; an auxiliary input port 322; an external DSP output port 324; and an instrument in port 326. Additionally, the following components are contained within the housing for sound augmentation system 210: a signal router 312; a DSP 314; a memory 316; a battery 318; an amplifier 380; and a vibrating driver 390. Additional information about these various components is presented below.

Figure 4:
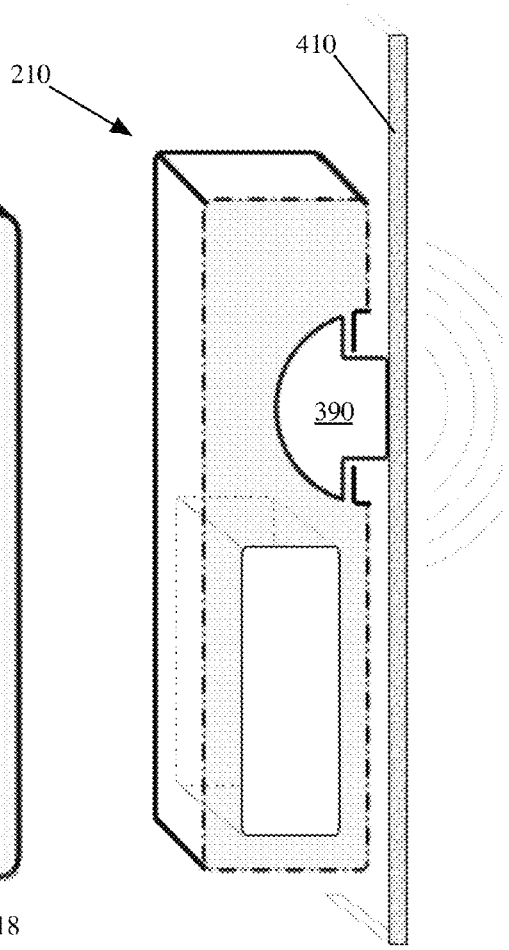
FIG. 4 is a side view of the housing of FIG. 3 affixed to a surface of a guitar for use in conjunction with a sound augmentation system in accordance with a preferred exemplary embodiment of the present invention.

Referring now to FIG. 4, a side view of the housing of FIG. 3 affixed to a surface of a guitar for use in conjunction with a sound augmentation system in accordance with a preferred exemplary embodiment of the present invention is depicted. As shown in FIG. 4, sound augmentation system 210 is affixed to a surface 410 of an acoustical musical instrument where vibrating driver 390 may contact surface 410 to induce vibrations.

Figure 5:
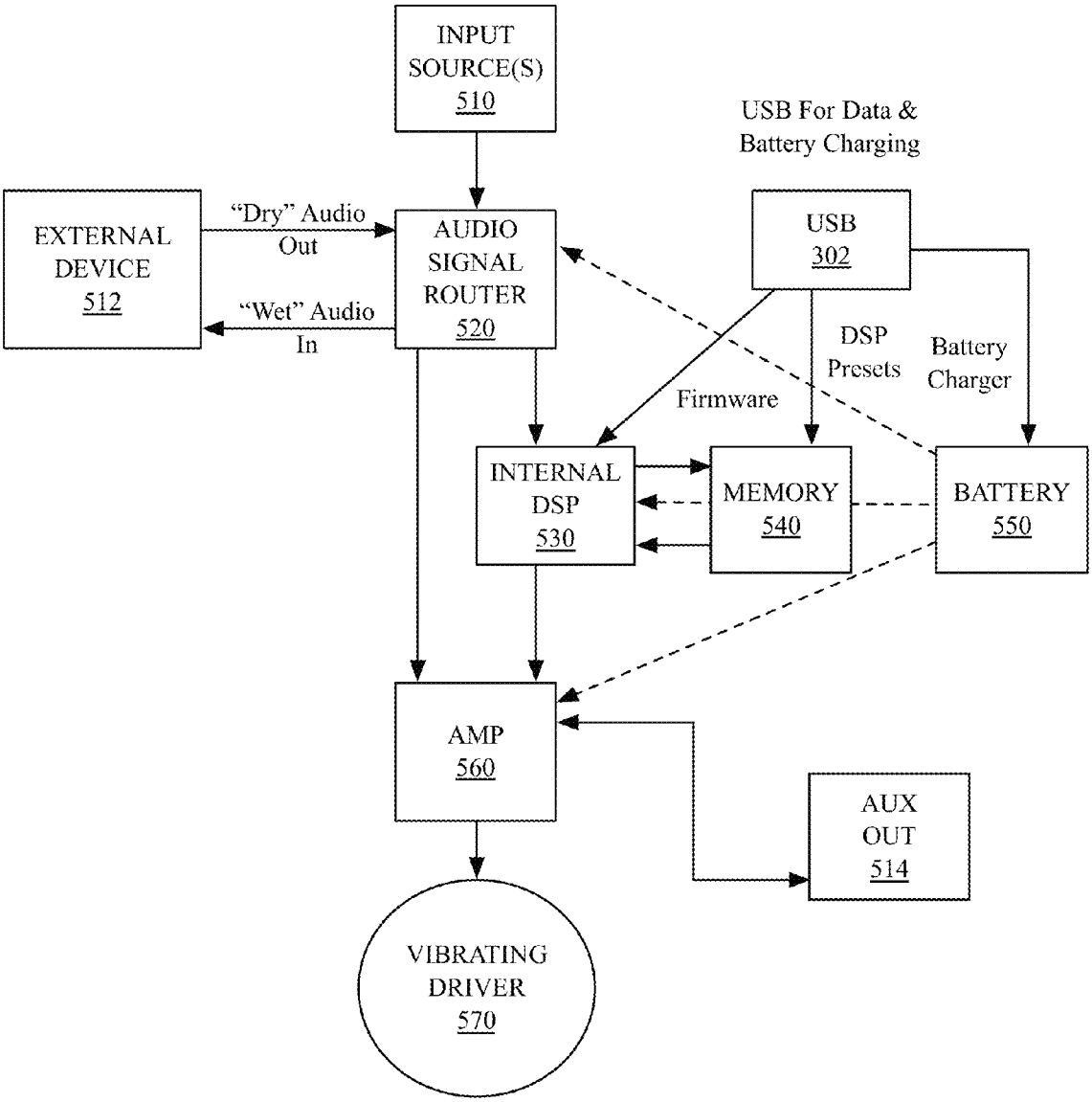
FIG. 5 is a block diagram of the major components of a sound augmentation system in accordance with a preferred exemplary embodiment of the present invention.

Referring now to FIG. 5, a block diagram of the major components for a sound augmentation system in accordance with a preferred exemplary embodiment of the present invention is depicted. As shown in FIG. 5, the most preferred embodiments of the sound augmentation system of the present invention comprises: a universal serial bus (USB) connection 302; a battery 550; one or more auxiliary output connectors 514; an audio signal router 520; an internal DSP 530; a memory 540; input source connections 510; an amplifier 560; and a vibrating driver 570.

USB port 302 is a standard connection used to couple the sound augmentation system to various other devices. For example, a computer could be coupled to USB port 302 and used to transfer one or more data files to memory 540, thereby providing a musician with the capability of loading custom sound files into memory 540. USB port 302 is a standard USB port and may be connected to any compatible device. USB port 302 may also provide a means for recharging battery 550 of the sound augmentation system. Additionally, firmware for operating DSP 530 and various DSP presets may be loaded via USB port 302.

Input source connection 510 comprises one or more standard connectors (e.g., RCA jacks, mini-plug jack, etc.) that can put used to provide an input signal to audio signal router 520.

Auxiliary output connectors 514; comprise any type of connector that would allow the sound augmentation system to be connected to various external devices for additional sound output options (e.g., amplifiers and speakers, receivers, mixers, etc.).

Signal router 520 is used to route the digital audio signal to the desired location. It will generally be used to route the digital audio signal from input source connections 510 to internal DSP 530. However, as shown in FIG. 5, signal router 520 may also be used to route the digital audio signal to external connections 512 so that the digital audio signal may first be processed by some external device prior to being returned to audio signal router 520 for routing to internal DSP 560.

Battery 550 provides a power source for the other components of the for sound augmentation system and, given the relatively low level of power consumption required, the exact battery capacity will depend on the specific application but can be selected from the group of generally available batteries known to those skilled in the art for powering portable electronic devices. In the most preferred embodiment of the present invention, battery 550 will be a rechargeable battery that can be recharged via USB port 302.

Internal DSP 530 is configured to provide real-time sound effect processing of the original source audio signal captured by the audio capture device which is then provided as the input to amplifier 560.

In the most preferred embodiments of the present invention, the optional external DSP comprises a third party sound effect processor or a mobile computing device such as a smart phone, a tablet, etc. could be connected to connector 512. It should be noted that the use of the external DSP is optional but will, in general, provide for a wider variety of optional sounds to be added to the original source signal generated by the musical instrument to which the sound augmentation system is affixed.

Memory 540 is any conventional computer memory known to those skilled in the art and is configured to store DSP settings or audio files (e.g., pre-selected sound effects, loops, etc.). The information stored in the memory may be transferred to the memory by using USB port 302. This allows the musician to store and readily access various sound effects without the need of creating them using an external DSP.

Amplifier 560 is used to amplify the augmented audio signal to the level necessary to drive vibrating driver 570 that, in turn, creates the vibration of the back surface of the musical instrument to which the sound augmentation system is attached.

Vibrating driver 570, (sometimes known as an "exciter"), is essentially a "diaphragm-less" speaker and is attached to the back surface of a musical instrument where it contacts the back surface of the musical instrument and transmits vibrations from the augmented audio signal, which is added to or layered with the source audio signal produced by the musical instrument. To reduce the weight and to keep vibrating driver 570 in a firm but flexible to vibrate position, the amplifier is typically housed in a mold, which can be partially or mostly made of foam or other similar substance.

Additionally, various input and output jacks or ports may also be included to allow the musician to connect the sound augmentation system to one or more auxiliary devices (e.g., mixing boards, external speakers, etc.). In this fashion, the original source audio signal and/or the augmented audio signal can be transferred to and from the sound augmentation system to provide for additional flexibility in various applications and environments.

Figure 6:
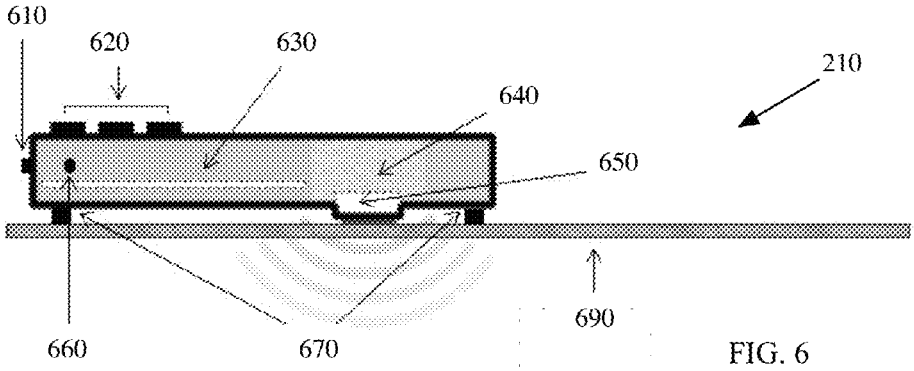
FIG. 6 is a block diagram of a sound augmentation system affixed to a surface of a musical instrument in accordance with a preferred exemplary embodiment of the present invention.

Referring now to FIG. 6, a schematic representation of a sound augmentation system 210 in accordance with a preferred exemplary embodiment of the present invention is depicted. As shown in FIG. 6, a case is used for sound augmentation system 210 comprises: an instrument input 610; one or more control knobs 620; an electronic board comprising components such as a pre-amp, amplifier, DSP, battery, etc.; soft padding material 640 surrounding a vibrating driver 650; one or more external device connectors 660; and a plurality of support legs 670.

Figure 7:
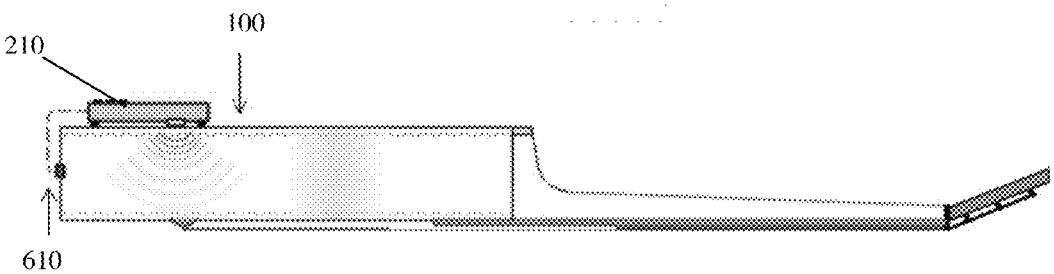
FIG. 7 is a block diagram of a sound augmentation system affixed to a surface of a guitar in accordance with a preferred exemplary embodiment of the present invention.

Referring now to FIG. 7, a side view of sound augmentation system 210 attached to a guitar 100 in accordance with a preferred exemplary embodiment of the present invention is depicted. As shown in FIG. 7, instrument input 610 is located at the end of the guitar.

Figure 8:
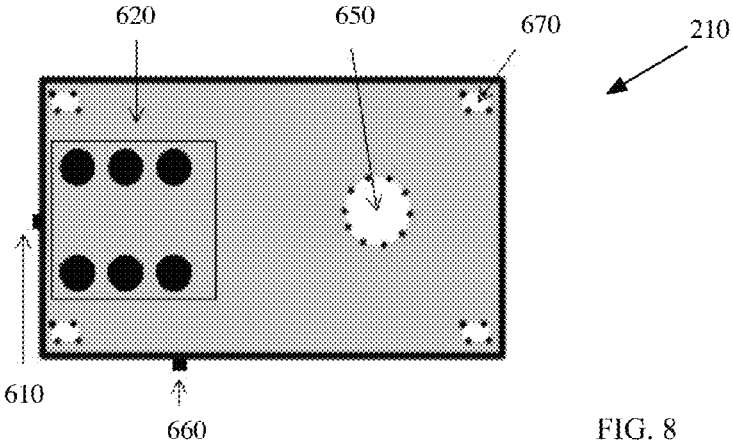
FIG. 8 is a top view of a sound augmentation system in accordance with a preferred exemplary embodiment of the present invention.

Referring now to FIG. 8, a top view of sound augmentation system 210 of FIG. 6 is depicted. The same components include an instrument input 610; one or more control knobs 620; an electronic board comprising components such as a pre-amp, amplifier, DSP, battery, etc.; soft padding material 640 surrounding a vibrating driver 650; one or more external device connectors 660; and a plurality of support legs 670.

There are a number of ways to attach sound augmentation system 210 to an acoustic instrument. Several non-limiting examples of attachment methods and attachment mechanisms are described below in the following figures.

Figure 9:
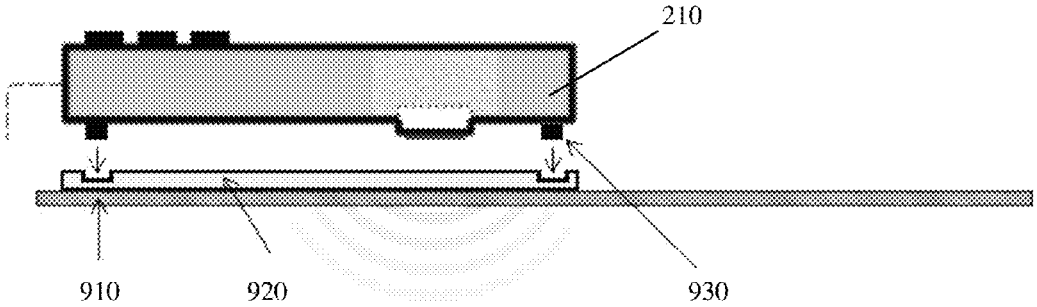
FIG. 9 is a schematic representations of a sound augmentation system affixed to a surface of a musical instrument using a magnetic pad in accordance with a preferred exemplary embodiment of the present invention.

Referring now to FIG. 9, a schematic representation of a sound augmentation system affixed to a surface of a musical instrument using a magnetic pad connection as an attachment mechanism in accordance with a preferred exemplary embodiment of the present invention is depicted. As shown in FIG. 9, a magnetic pad 920 is affixed to a surface 910 of musical instrument. Magnetic pad 920 may be affixed using any type of adhesive but for most embodiments, a non-aggressive adhesive that can be applied and removed without damaging instrument surface 910 will be selected.

For this embodiment, sound augmentation system 210 will be manufactured with a plurality of magnetic legs 930 that are sized to fit into cooperating recesses formed in magnetic pad 920. When magnetic legs 930 are positioned in close proximity to magnetic pad 920, magnetic legs 930 will "snap" into place and be "locked" into the cooperating recesses formed in magnetic pad 920, thereby securing sound augmentation system 210 in the proper position relative to instrument surface 910. As will be appreciated by those skilled in the art, this embodiment of the invention allows for sound augmentation system 210 to be quickly and easily removed from an instrument. Additionally, if a musician owns multiple instruments, they could purchase multiple magnetic pads 920 and switch a single sound augmentation system between multiple instruments.

Figure 10:
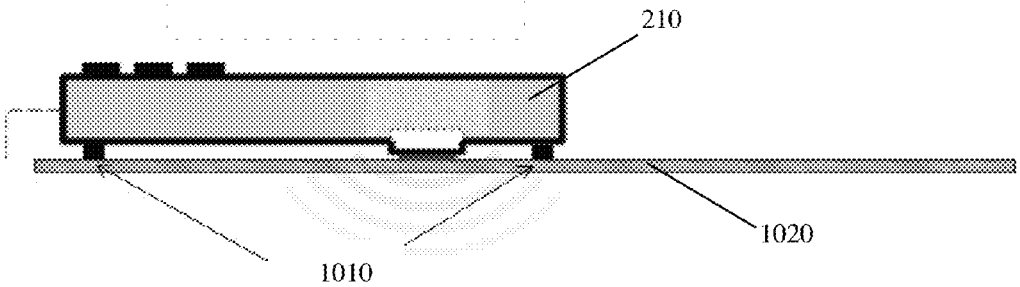
FIG. 10 is a schematic representation of a sound augmentation system affixed to a surface of a musical instrument in accordance with an alternative preferred exemplary embodiment of the present invention.

Referring now to FIG. 10, a schematic representation of a sound augmentation system affixed to a surface of a musical instrument using one or more adhesive compounds as an attachment mechanism in accordance with an alternative preferred exemplary embodiment of the present invention is depicted. As shown in FIG. 10, sound augmentation system 210 comprises a plurality of legs 1010 that comprise an adhesive capability that will allow the musician to securely yet removably affix sound augmentation system 210 to the surface of an instrument.

For example, in this embodiment, the musician has the option of attaching the sound augmentation system directly to the instrument backside. The legs and/or an associated cavity may host different options of reusable non-destructive attachment mechanisms such as nano-suction pads, standard suction cups, reusable putty or other type of reusable adhesive.

Figure 11:
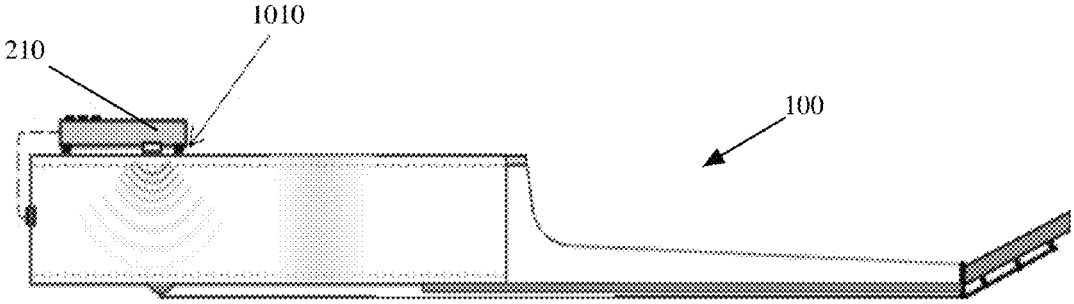
FIG. 11 is a side view of a sound augmentation system affixed to a surface of a guitar using a reusable adhesive in accordance with a preferred exemplary embodiment of the present invention.

Referring now to FIG. 11, a schematic representation of sound augmentation system 210 affixed to guitar 100 with adhesive legs 1010 in accordance with a preferred exemplary embodiment of the present invention is depicted.

Figure 12:
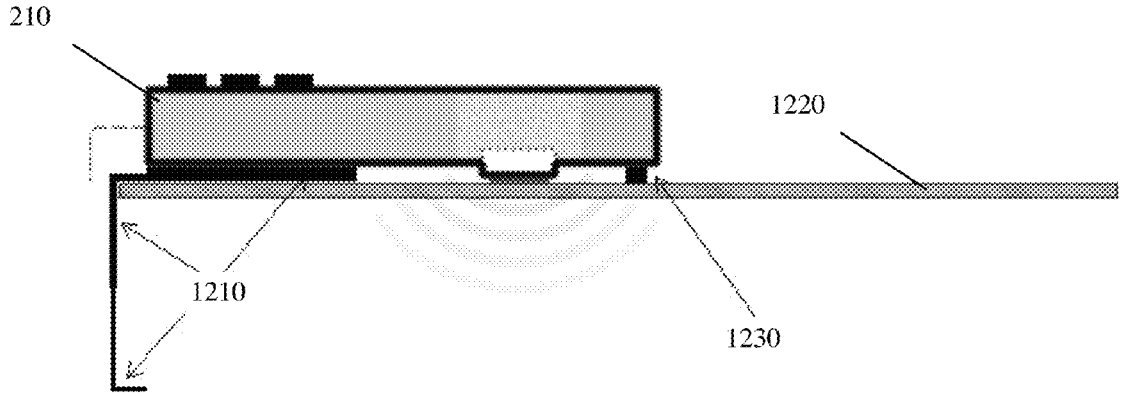
FIG. 12, FIG. 13, and FIG. 14 provide a schematic representation of a sound augmentation system affixed to a surface of a musical instrument using a clamping unit in accordance with a preferred exemplary embodiment of the present invention.
Figure 13:
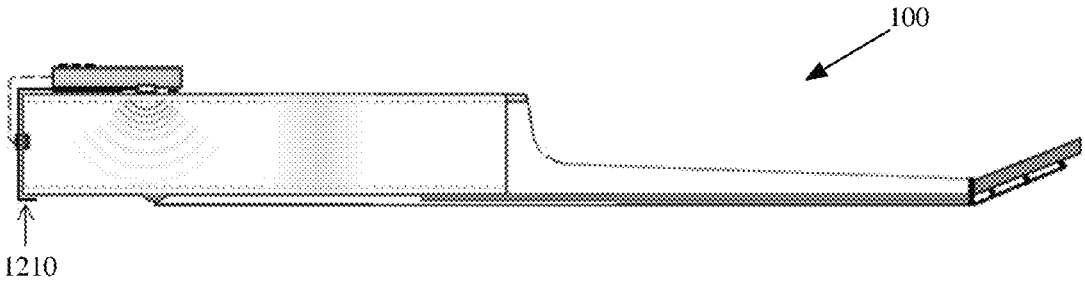
Figure 14:
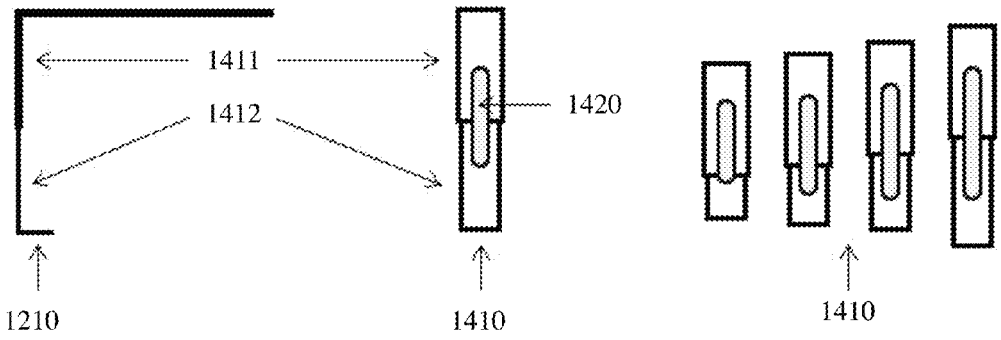

Referring now to FIG. 12, FIG. 13, and FIG. 14, a schematic representation of a clamping system for attaching a sound augmentation system to a musical instrument in accordance with a preferred exemplary embodiment of the present invention is depicted. The embodiment is provided for musicians for prefer a sound augmentation system that can be quickly and easily removed from the instrument without leaving any trace of the sound augmentation system behind. As shown in FIG. 12, sound augmentation system 210 can be affixed to an adjustable clamping unit 1210 (using adhesives, screws, etc.) and then the combination unit can be clamped onto a surface of an instrument body 1220. As previously mentioned, one or more support legs 1230 may also be included to provide the proper offset of sound augmentation system 210 from instrument body 1220.

Referring now to FIG. 13, a schematic representation of clamping unit 1210 attached to guitar 100 is depicted. Clamping unit 1210 will most preferably be coated with a protective or rubberized finish for all surfaces that may contact the body of the musical instrument so as to ensure the body of the musical instrument is not damaged.

Referring now to FIG. 14, a schematic representation of the adjustment function for a adjustable clamping unit **1210*a* for use in conjunction with a sound augmentation system in accordance with a preferred exemplary embodiment of the present invention is depicted. As shown in FIG. 14, adjustable clamping unit 1210 comprises to interlocking and sliding pieces 1411 and 1412. Sliding piece 1411 is sized so as to slide into sliding piece 1412 and lock in place, thereby securing adjustable clamping unit 1210 to secure adjustable clamping unit 1210** to the body of an instrument such as a guitar.

Additionally, adjustable clamping unit 1210 further comprises an aperture 1420 which is configured to accept a standard guitar strap mounting peg. Adjustable clamping unit 1210 can be positioned over a standard guitar strap mounting peg and the mounting peg will protrude through aperture 1420, allowing the musician to attach a guitar strap to the guitar while adjustable clamping unit 1210 remains attached to the guitar. Further, a plurality of adjustable clamping unit 1210 may be provided so as to ensure that adjustable clamping unit 1210 can be used on various sizes of guitar bodies.

Figure 15:
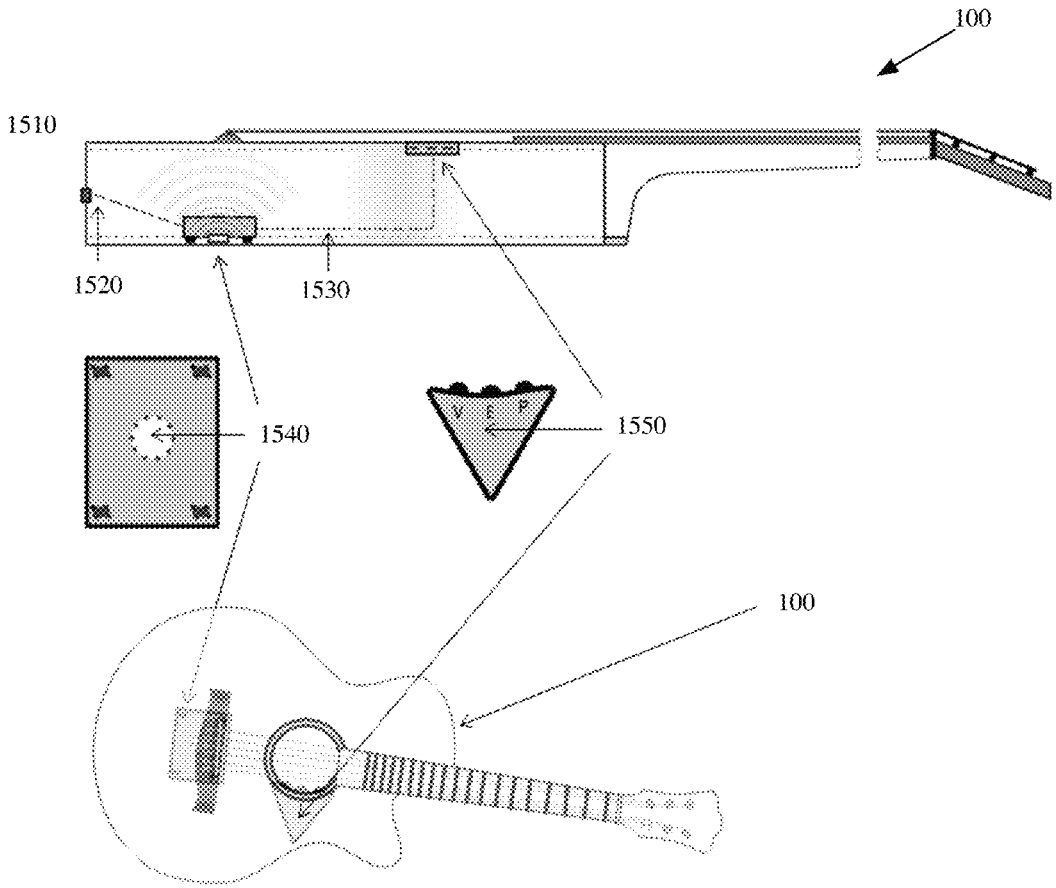
FIG. 15 is a schematic representation of a guitar with a sound augmentation system configured to be installed inside a musical instrument in accordance with an alternative preferred exemplary embodiment of the present invention.

Referring now to FIG. 15, a schematic representation of a sound augmentation system in accordance with a preferred exemplary embodiment of the present invention is depicted. As shown in FIG. 15, guitar 100 is presented in both a side view and a top view so as to relate the positioning of the various components of this embodiment of a sound augmentation system. This embodiment of the present invention is designed for musicians who prefer a hidden and more permanent installation of the sound augmentation system. This may also be a preferred embodiment for instrument manufacturers who wish to include the sound augmentation system as a factory built option.

In this embodiment, the sound augmentation system is divided to two main components: a master unit 1540 comprising the audio capture and processing elements (e.g., amplifiers, DSP, vibrating driver etc.); and a control unit 1550 that comprises a series of control knobs for controlling the sound augmentation functions by providing at least one of a series of pre-configured sound augmentation signals (e.g., volume, reverb, echo effects, etc.). that alter the original sound from the instrument. Control unit 1550 is most preferably positioned near the sound hole of the instrument so that the musician can simply reach inside the sound hole to adjust the sound augmentation functions. This embodiment of the present invention provides a completely hidden system that instrument manufacturers to pre-install into new instruments.

As shown in FIG. 15, instrument output 1510 is communicatively coupled to master unit 1540 by a connection 1520. Similarly, control unit 1550 is communicatively coupled to master unit 1540 by a connection 1530. The buttons on control unit 1550 may be used to control and modify the sound augmentation. For example, depending on the specific application, one control knob may be provided to control the volume level. Another control knob may be provided to select one of multiple effects with yet another control knob being configured to control the strength, level, and duration of a given sound augmentation effect.

Figure 16:
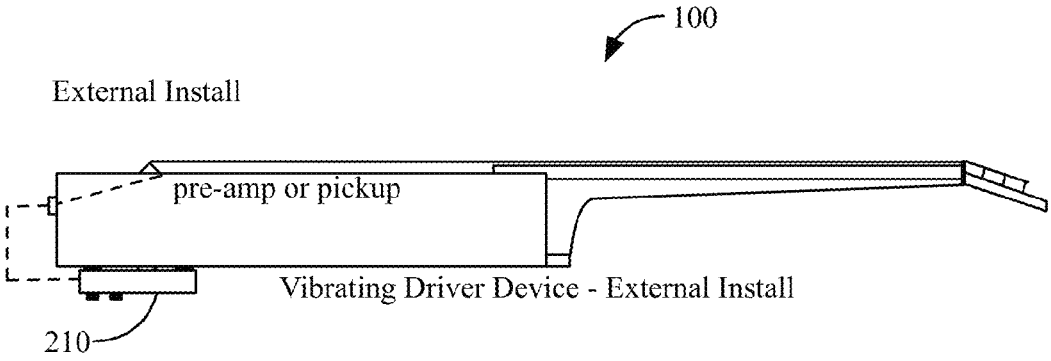
FIG. 16 is a schematic representation of a guitar with a sound augmentation system installed on the exterior surface of the guitar in accordance with a preferred exemplary embodiment of the present invention is depicted.

Referring now to FIG. 16, a schematic representation of a guitar with a sound augmentation system affixed to the exterior of the guitar in accordance with a preferred exemplary embodiment of the present invention is depicted. As shown in FIG. 16, system 210 may also be installed externally and connected to a pre-amplifier.

Figure 17:
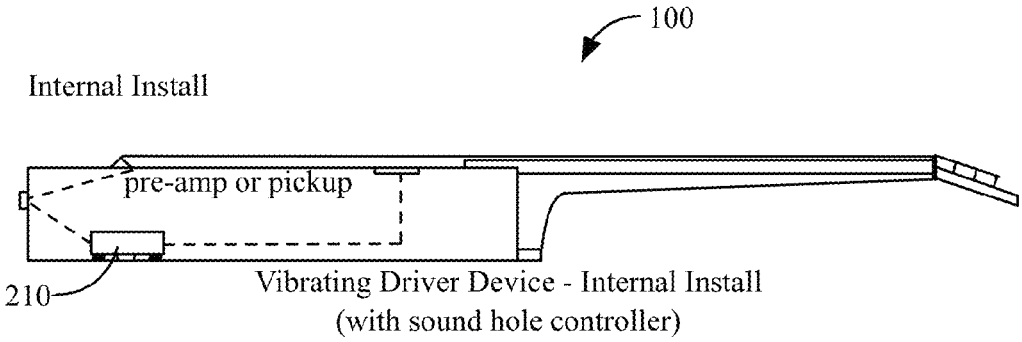
FIG. 17 is a schematic representation of a guitar with a sound augmentation system installed inside the guitar in accordance with a preferred exemplary embodiment of the present invention.

Referring now to FIG. 17, a schematic representation of a guitar with a sound augmentation system installed inside the guitar in accordance with a preferred exemplary embodiment of the present invention is depicted. As shown in FIG. 17, system 210 may also be installed internally and connected to a pre-amplifier.

Those skilled in the art will appreciate that the various preferred embodiments of the present invention can be use to digitally augment any acoustic instrument such as the acoustic guitar, and provide the capability to reproduce acoustically an added layer of special spatial effects (e.g., reverb, delay, echo etc.).

Additionally, the various preferred embodiments of the present invention provide for enhanced sound augmentation without the need for external amplifiers, effect pedals, speaker cabinets, and with zero modifications to the instrument itself. With the various preferred embodiments of the present invention provide a stand-alone acoustic instrument will have the ability reproduce augmented sound using the body of the acoustical instrument add a layer of beautiful spatial effects in addition to its natural organic sound.

The various preferred embodiments of the present invention are suitable for practicing, song writing and traveling, when special effects are desired but that would otherwise not be accessible without bulky and cumbersome outboard equipment.

The invention can be installed on the exterior or interior of any existing acoustic guitar (or any other capable acoustic instrument) with similar results and with zero modifications to the instrument itself.

The musician can quickly and easily install the various embodiments on an acoustical guitar or other acoustical instrument. No professional help is required and no permanent modifications to the instrument are required in order to use the various preferred embodiments.

Although the various preferred embodiments of the present invention comprise a DSP it is also configured to connect with outside DSP devices including digital DSP software programs available via smartphones and tablets. The ability to use both internal DSP coupled with an external DSP provides a powerful combination of a device independence, and a device openness for future possibilities.

Additionally, by using one or more of the quick, easy and flexible ways of attaching/detaching the sound augmentation system of the present invention, a single sound augmentation system can be quickly moved and used on many instruments.

From the foregoing description, it should be appreciated that the system and method for sound augmentation disclosed herein presents significant benefits that would be apparent to one skilled in the art. For example, the sound augmentation system could be used in conjunction with violins, cellos, etc. Furthermore, while multiple embodiments have been presented in the foregoing description, it should be appreciated that a vast number of variations in the embodiments exist. For example, even though the sound augmentation system described herein has been described as not being coupled to external speakers, the augmented audio signal may be provided to one or more external speakers and amplified via conventional means, if desired.

Lastly, it should be appreciated that these embodiments are preferred exemplary embodiments only and are not intended to limit the scope, applicability, or configuration of the invention in any way. Rather, the foregoing detailed description provides those skilled in the art with a convenient road map for implementing one or more preferred exemplary embodiments of the invention, it being understood that various changes may be made in the function and arrangement of elements described in the exemplary preferred embodiment without departing from the spirit and scope of the invention as set forth in the appended claims.

The invention claimed is:

1. A sound augmentation system comprising:

an acoustic instrument, the acoustic instrument comprising:

a front surface, the front surface comprising a sound hole;

a plurality of strings extending over the sound hole; and a back surface positioned substantially parallel to the front surface;

a sound capture device attached to the back surface of the acoustic instrument by an attachment mechanism, the attachment mechanism providing for selective attachment and removal of the sound capture device wherein the sound capture device captures a first sound produced by the acoustic instrument, the sound capture device further comprising:

an input source connection communicatively coupled to the sound capture device;

an audio signal router communicatively coupled to the input source connection, the audio signal router receiving a digital audio signal from the sound capture device;

a digital signal processor communicatively coupled to the audio signal router;

an amplifier communicatively coupled to the digital signal processor;

a vibrating driver coupled to the amplifier by one of an electronic cable and a wireless connection and receiving a digital signal from the amplifier; and a battery electrically connected to each of the audio signal router and the digital signal processor and the amplifier and wherein the vibrating driver is positioned to selectively contact the flat surface of the acoustic instrument and create a vibration of the surface of the acoustic instrument based on the digital signal received from the amplifier to produce an augmented audio signal.

2. The sound augmentation system of claim 1 wherein the acoustic instrument comprises at least one of a guitar, a ukulele, a violin, a viola, and a banjo.

3. The sound augmentation system of claim 1 wherein the attachment mechanism comprises a clamping unit.

4. The sound augmentation system of claim 1 wherein the attachment mechanism comprises:

a pad affixed to the surface of the acoustic instrument; and at least one leg affixed to the housing, the at least one leg being magnetically attracted to the pad.

5. The sound augmentation system of claim 1 wherein the attachment mechanism comprises an adhesive.

6. The sound augmentation system of claim 1 wherein the augmented audio signal comprises an audio effect comprising at least one reverb, delay, and echo.

7. The sound augmentation system of claim 1 wherein the housing further comprises a plurality of control knobs, the plurality of control knobs being configured to alter the augmented audio signal.

8. The sound augmentation system of claim 1 wherein the housing further comprises a plurality of control knobs, the plurality of control knobs being configured to alter the augmented audio signal by providing at least one of a series of pre-configured sound augmentation signals.

9. The sound augmentation system of claim 1 further comprising an electronic pickup placed over the sound hole, the electronic pickup capturing the first sound.

10. The sound augmentation system of claim 1 further comprising:

a universal serial bus port coupled to each of the battery, the memory, and the internal digital signal processor;

an auxiliary output port;

an auxiliary input port; and an external digital signal processor port.

11. The sound augmentation system of claim 10 further comprising an external digital signal processing device communicatively coupled to the external digital signal processor port, the external digital signal processing device comprising at least one of a smart phone, a tablet computer, and a desktop computer.

12. A method of creating an augmented audio signal from an acoustic instrument, the method comprising the steps of:

attaching a vibrator to the acoustic instrument using an attachment mechanism, the acoustic instrument comprising:

a front surface, the front surface comprising a sound hole;

a plurality of strings extending over the sound hole; and a back surface positioned substantially parallel to the front surface;

wherein the vibrator is attached to the back surface of the acoustic instrument, the attachment mechanism providing for selective attachment and removal of the vibrator, coupling the vibrator to a first digital signal processor by one of an electronic cable and a wireless connection;

capturing an audio signal from the acoustic instrument using a sound capture device attached to the acoustic instrument by an attachment mechanism;

transmitting the audio signal to the first digital signal processor;

processing the audio signal with the first digital signal processor to produce an augmented audio signal; and driving the vibrator with the augmented audio signal, thereby impacting the flat portion of the acoustic instrument to induce vibrations in a sound chamber of the acoustic instrument.

13. The method of claim 12 further comprising the steps of:

loading at least one audio file to a memory via a universal serial bus port;

storing the at least one audio file to a memory; and accessing the at least one audio file to process the audio signal with the digital signal processor to produce the augmented audio signal.

14. The method of claim 12 wherein the acoustic instrument comprises at least one of a guitar, a ukulele, a violin, a viola, and a banjo.

15. The method of claim 12 further comprising the step of connecting a second digital signal processing device to the sound augmentation system, the second digital signal processing device comprising at least one of a smart phone, a tablet computer, and a desktop computer.

16. The method of claim 12 further comprising the step of placing an electronic pickup placed over the sound hole, the electronic pickup capturing the audio signal.

17. A sound augmentation system comprising:

an acoustic instrument, the acoustic instrument comprising:

a front surface, the front surface comprising a sound hole;

a plurality of strings extending over the sound hole; and a back surface positioned substantially parallel to the front surface;

a sound capture device attached to the back surface of the acoustic instrument by an attachment mechanism, the sound capture device capturing a first sound produced by the acoustic instrument;

a master unit, the master unit comprising:

an input source connection communicatively coupled to the sound capture device;

an audio signal router communicatively coupled to the input source connection, the audio signal router receiving an audio signal from the sound capture device;

a digital signal processor communicatively coupled to the audio signal router;

an amplifier communicatively coupled to the digital signal processor; and a vibrating driver communicatively coupled to the amplifier and received a digital signal from the amplifier; and a control unit, the control unit comprising a plurality of knobs that are configured to alter at least one characteristic of the first sound produced by the acoustic instrument and wherein the vibrating driver is positioned to selectively contact a surface of the acoustic instrument and create a vibration of the surface of the acoustic instrument based on the digital signal received from the amplifier to produce an augmented audio signal.

18. The sound augmentation system of claim 17 further comprising a second digital signal processing device communicatively coupled to the sound augmentation system, the second digital signal processing device comprising at least one of a smart phone, a tablet computer, and a desktop computer.

19. The sound augmentation system of claim 17 further comprising an electronic pickup placed over the sound hole, the electronic pickup capturing the first sound.

* * * * *